US006085902A

United States Patent [19]

Fang

[11] Patent Number: 6,085,902

[45] Date of Patent: Jul. 11, 2000

[54] ARTICLE TRANSPORT AND ORGANIZER

[75] Inventor: Liping Fang, City of Industry, Calif.

[73] Assignee: Olympia Industrial, Inc., City of Industrial, Calif.

[21] Appl. No.: 09/212,673

[22] Filed: Dec. 16, 1998

[51] Int. Cl.[7] ..... B65D 85/20; B65D 30/22; B65D 33/32

[52] U.S. Cl. ..... 206/373; 220/694; 220/735; 383/39; 383/67

[58] Field of Search ..... 206/372, 373; 383/38–40, 67; 220/694, 735, 212

[56] References Cited

U.S. PATENT DOCUMENTS

| | | | |
|---|---|---|---|
| D. 345,237 | 3/1994 | Stein . | |
| 2,028,309 | 1/1936 | Adams | 383/67 X |
| 2,684,097 | 7/1954 | Treul | 383/67 X |
| 2,687,755 | 8/1954 | Smith | 383/67 X |
| 2,802,501 | 8/1957 | Stember | 383/67 X |
| 2,979,098 | 4/1961 | Greaves | 383/40 X |
| 3,110,333 | 11/1963 | Stember | 383/67 X |
| 3,403,716 | 10/1968 | Siris | 383/38 X |
| 4,718,524 | 1/1988 | Crumley | 383/39 X |
| 4,765,381 | 8/1988 | Castle | 383/67 X |
| 4,765,472 | 8/1988 | Dent | 206/373 |
| 4,773,535 | 9/1988 | Cook | 206/373 |
| 4,993,551 | 2/1991 | Lindsay . | |
| 5,174,447 | 12/1992 | Fleming | 206/373 |
| 5,288,150 | 2/1994 | Bearman | 383/67 X |
| 5,429,265 | 7/1995 | Maine et al. | 206/373 X |
| 5,653,337 | 8/1997 | Cirigliano | 206/373 |

*Primary Examiner*—Bryon P. Gehman
*Attorney, Agent, or Firm*—James E. Brunton, Esq.

[57] ABSTRACT

An article transport and organizer which can conveniently be used either as a tote bag for transport and storage of small articles or alternatively can be used in connection with an empty container such as a five-gallon bucket for the transport and storage of larger articles as well as for the transport of smaller articles and tools. The apparatus includes a removable shoulder strap that can be used to conveniently transport the apparatus when it is being used as a tote bag. The inner and outer skirt-like walls of the apparatus are provided with a plurality of spaced-apart pockets which are adapted to receive and organize hand tools and other small articles. Easy-to-operate zipper mechanisms are provided for interconnecting together the lower margins of the outer skirt-like walls so as to convert the apparatus from a bucket organizer into a tote bag.

9 Claims, 7 Drawing Sheets

50
52
50
48
46
14a
14
A
20
16
16a
48
32
46a
40
32
46
34
40
32
22b
34
40
36
42
32
34
42
34
38
42
16b
22a
-38-
22b
22

ARTICLE TRANSPORT AND ORGANIZER

BACKGROUND OF THE INVENTION

1. Field of the Invention

The present invention relates generally to devices for the storage and transport of small articles. More particularly, the invention concerns a novel organizer apparatus which is usable either as a tote bag or with an empty five gallon container for the organization and transport of small tools and supplies from one work site to another.

2. Discussion of the Prior Art

Many craftsmen use tote bags of various configuration for the storage and transport of numerous types of supplies, small articles and small tools. Such tote bags are typically constructed from canvas or like material and provide a top opening interior compartment for the receipt and transport of the tools, articles and supplies. Typically, the prior art tote bags are provided with a shoulder strap for carrying the bag and also often include pockets formed on the interior walls of the tote bag for receipt of small tools and the like. A drawback of the prior art tote bags is that the interior storage compartments of the bags are of limited size and are not well adapted for receipt of bulky supplies and other work articles which need to be routinely transported from location to location.

To provide means for the transport of small tools and articles as well as larger and more bulky articles, many workmen use empty five-gallon buckets for the storage and transport of such articles. These empty five-gallon plastic containers provide an inexpensive means for the transport of tools and other more bulky articles from workplace to workplace. In similar fashion, gardeners often use empty containers such as five-gallon buckets to store and transport gardening tools and supplies. While these empty containers function well to transport a wide variety of small articles, the articles have a tendency to intermingle proximate the bottom of the bucket making their retrieval frustrating, time consuming and difficult.

The storage and transport apparatus of the present invention provides an elegant solution to the aforementioned problems experienced in the use of both tote bags and empty five-gallon containers. More particularly, the novel apparatus of the present invention can be conveniently used as a tote bag to transport and store tools and other small articles or alternatively can be used in connection with empty containers, such as five-gallon buckets for the orderly storage and transport of tools and larger more bulky articles.

The apparatus of one form of the present invention comprises an inner skirt-like wall and a cooperating outer skirt-like wall which is interconnected with the inner skirt-like wall proximate the tipper margin thereof. When the apparatus is used in conjunction with a five-gallon container, the apparatus is draped over the container so that the inner skirt-like wall depends downwardly within the interior of the container while the outer skirt-like wall depends downwardly over the outer surface of the container. The outer skirt-like wall of the container has a length greater than the inside skirt-like wall so that the lower margins thereof can be releasably interconnected by connector means such as a heavy duty zipper or the like. More particularly, when the apparatus is used as a tote bag, the connector or closure means are used to interconnect the lower margins of the outer skirt so as to define an interior compartment similar to the interior compartment of prior art tote bags within which tools and small articles can be placed. Uniquely, both the inner and outer skirt-like walls of the apparatus are provided with a plurality of circumferentially spaced pockets which are adapted to receive an organize small tools and various types of articles which are frequently transported from location to location. With this construction, when the apparatus is used either as a tote bag or used in connected with an empty five-gallon container, the various compartments enable the workman to efficiently organize the small articles and then at time of use quickly and easily select a particular article from one of the spaced-apart pockets formed in the organizer apparatus.

SUMMARY OF THE INVENTION

It is an object of the present invention to provide an article transport and organizer which can conveniently be used either as a tote bag for transport and storage of small articles or, alternatively, can be used in connection with an empty container such as a five-gallon bucket for the transport and storage of larger articles as well as for the transport of smaller articles and tools.

Another object of the invention is to provide an apparatus, the aforementioned character of which includes a removable shoulder strap that can be used to conveniently transport the apparatus when it is being used as a tote bag.

Another object of the invention is to provide an article transport and organizer of the character described which includes inner and outer skirt-like walls, the exposed surfaces of which are provided with a plurality of spaced-apart pockets which are adapted to receive and organize hand tools and other small articles.

Another object of the invention is to provide an article transport and organizer as described in the preceding paragraph in which easy-to-operate closure means are provided for interconnecting together the lower margins of the outer skirt-like walls so as to convert the apparatus from a bucket organizer into a tote bag.

Another object of the invention is to provide an apparatus of the class described which is of simple construction, is durable in use, and can be inexpensively manufactured.

DESCRIPTION OF THE INVENTION

Figure 8:
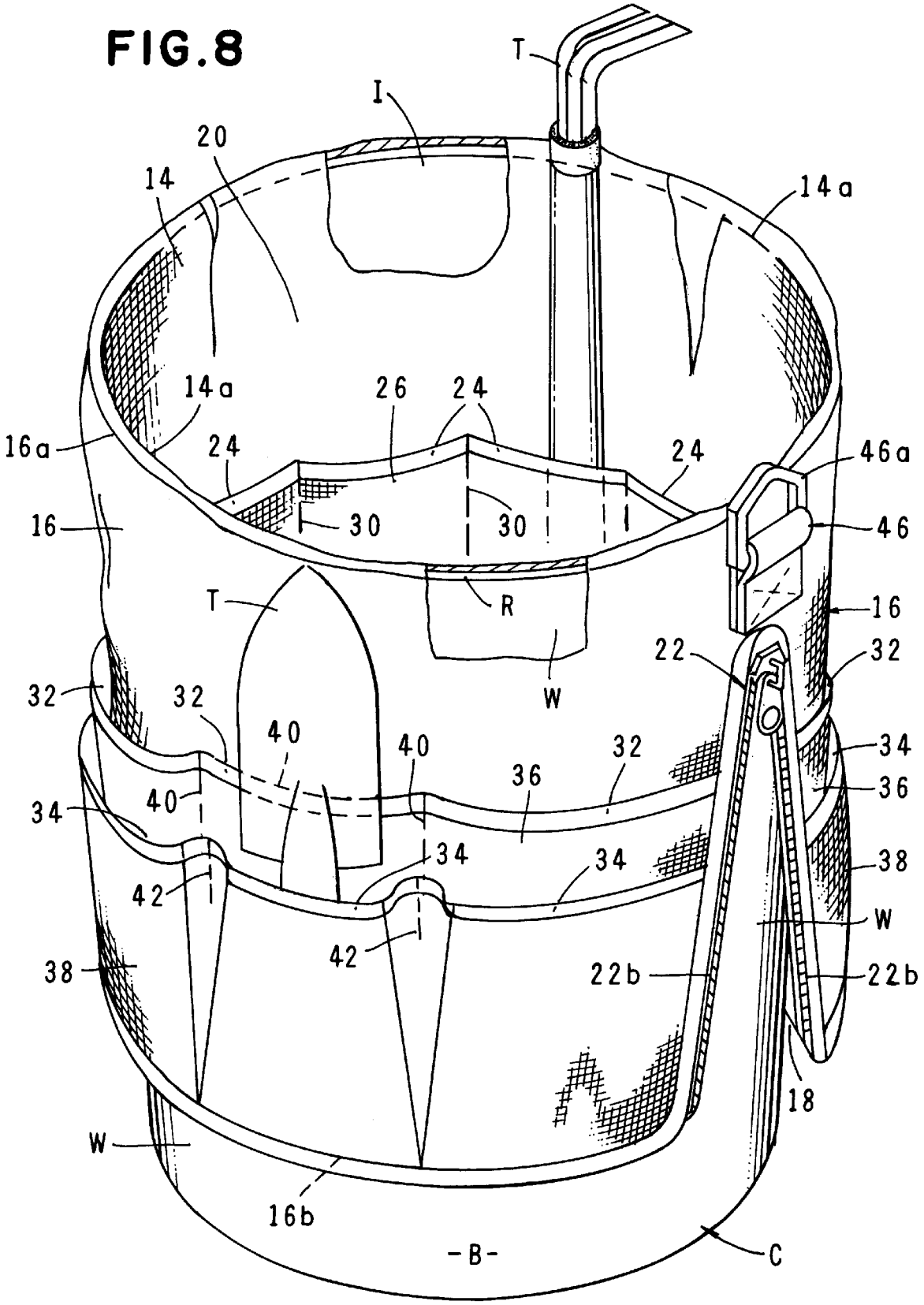
FIG. 8 is a generally perspective view of the apparatus shown in FIG. 7 as it appears when used as a bucket organizer with the skirt-like portions thereof draped over the upper rim of an empty container such as a five-gallon plastic paint container.
Figure 9:
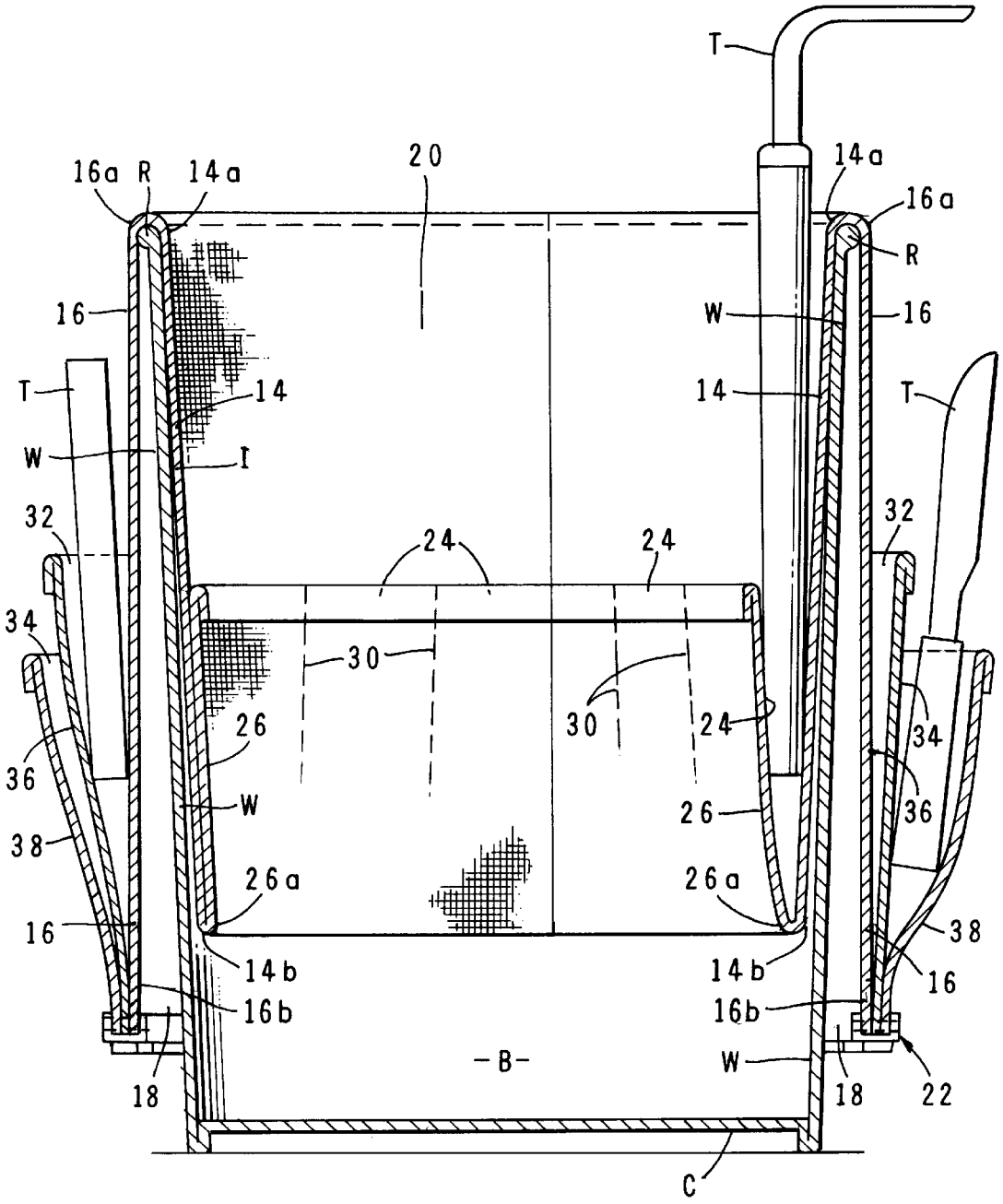
FIG. 9 is a side-elevational, cross-sectional view of the organizer as it appears when draped over a container in the manner illustrated in FIG. 8.

Referring to the drawings and particularly to FIGS. 1 through 6, one form of the combination tote bag and bucket organizer apparatus of the invention is there shown. The apparatus as illustrated in FIGS. 1 through 6 takes the form of a portable tote bag for the transport and storage of small tools and articles. On the other hand, the apparatus as illustrated in FIGS. 8 and 9 takes the form of a bucket organizer which is used in connection with an empty container such as a five-gallon plastic paint container "C". In a manner presently to be described, the apparatus can be readily converted from the first tote bag form shown in FIGS. 1 through 6 to the second bucket organizer form shown in FIGS. 8 through 9 by simply opening the closure means of the invention, which is here depicted as a conventional zipper-like mechanism.

Figure 6:
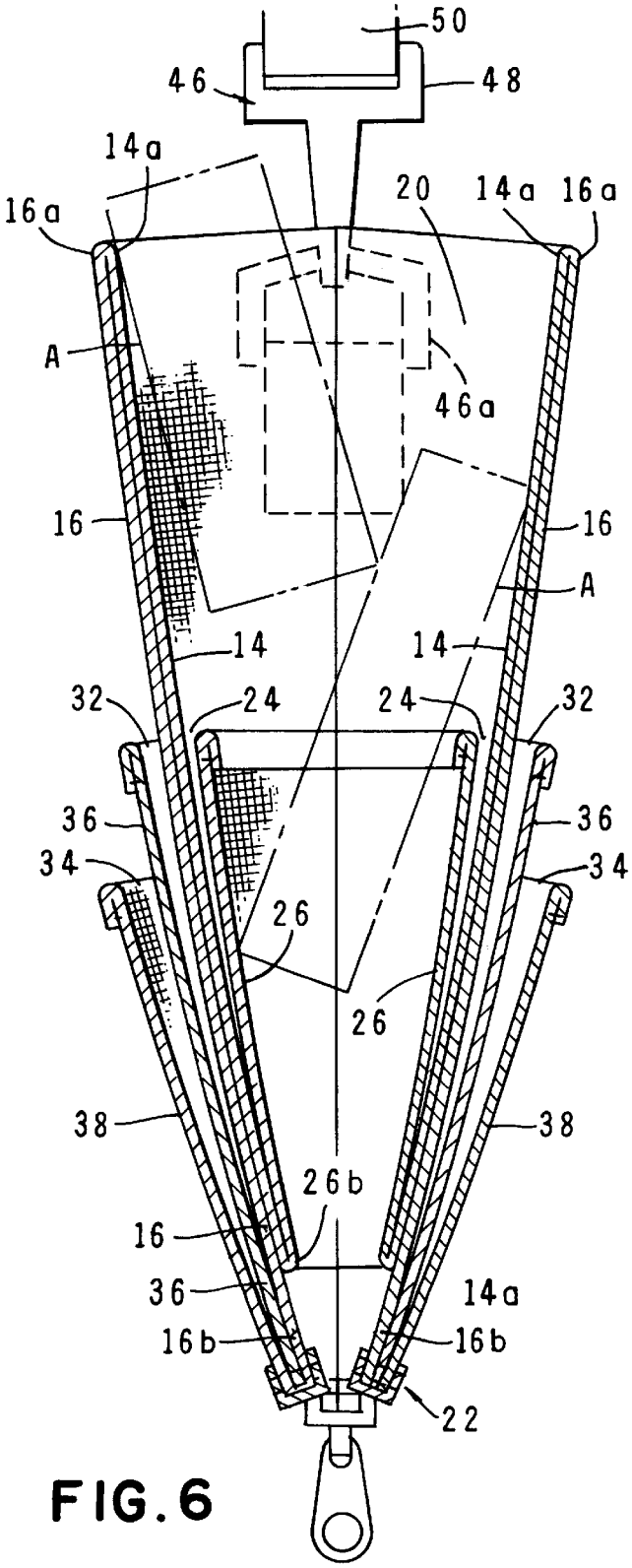
FIG. 6 is an enlarged, cross-sectional view taken along lines 6—6 of FIG. 2.

Turning particularly to FIGS. 6 and 9, the apparatus can be seen to comprise a first skirt-like, downwardly depending, flexible wall 14, and a second skirt-like, downwardly depending, flexible wall 16. Walls 14 and 16 have upper marginal portions designated as 14*a* and 16*a*, respectively. In the form of the invention shown in the drawings, walls 14 and 16 are integrally connected proximate their tipper marginal portions 14*a* and 16*a*, but could be provided as separate panels which are sewn together or otherwise joined. As best seen in FIG. 9, wall 14 has a lower marginal portion 14*b* and wall 16 has a lower marginal portion 16*b*. As also depicted in FIG. 9, downwardly depending wall 14 is of a first length, while downwardly depending wall 16 is of a second, greater length.

When the apparatus of the invention is in its open, bucket organizer configuration as shown in FIGS. 8 and 9, downwardly depending outside wall 16 terminates in a generally circular shaped opening 18 and is closely received about the external wall "W" of the empty container "C". Container "C" is of a conventional configuration having the external wall "W" and an internal wall "I" (FIG. 9), which is generally circular in cross section at any point. Wall "W" terminates in a upper rim portion "R" of the character shown in FIG. 9.

Figure 3:
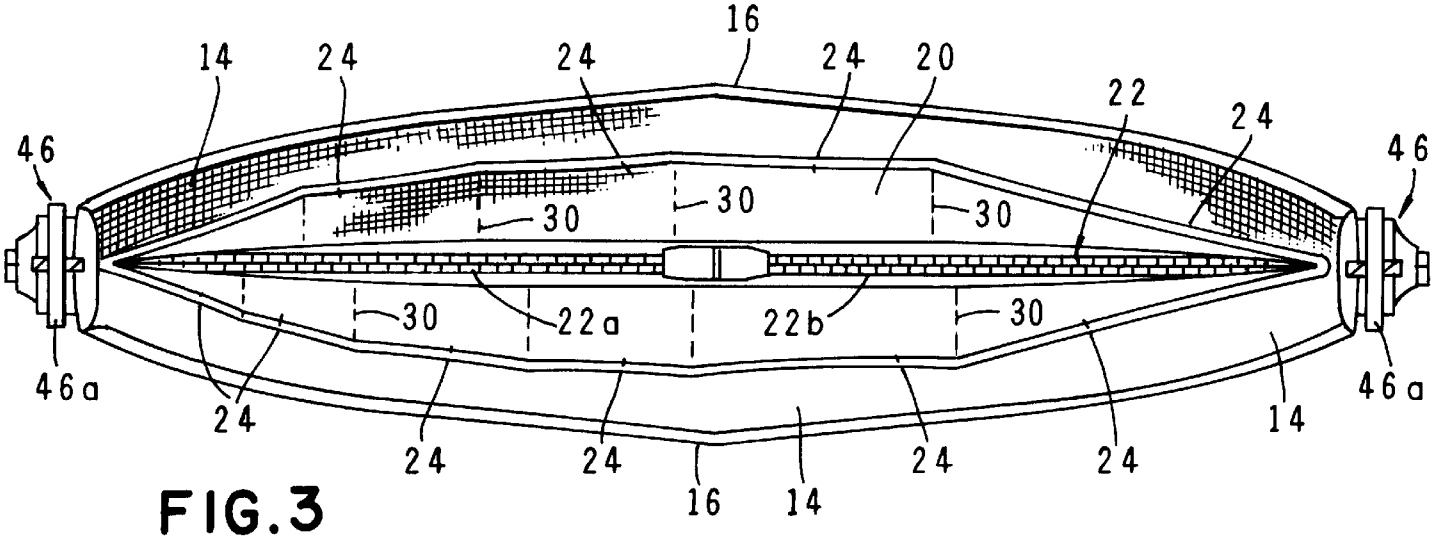
FIG. 3 is a view taken along FIGS. 3—3 of FIG. 2.
Figure 4:
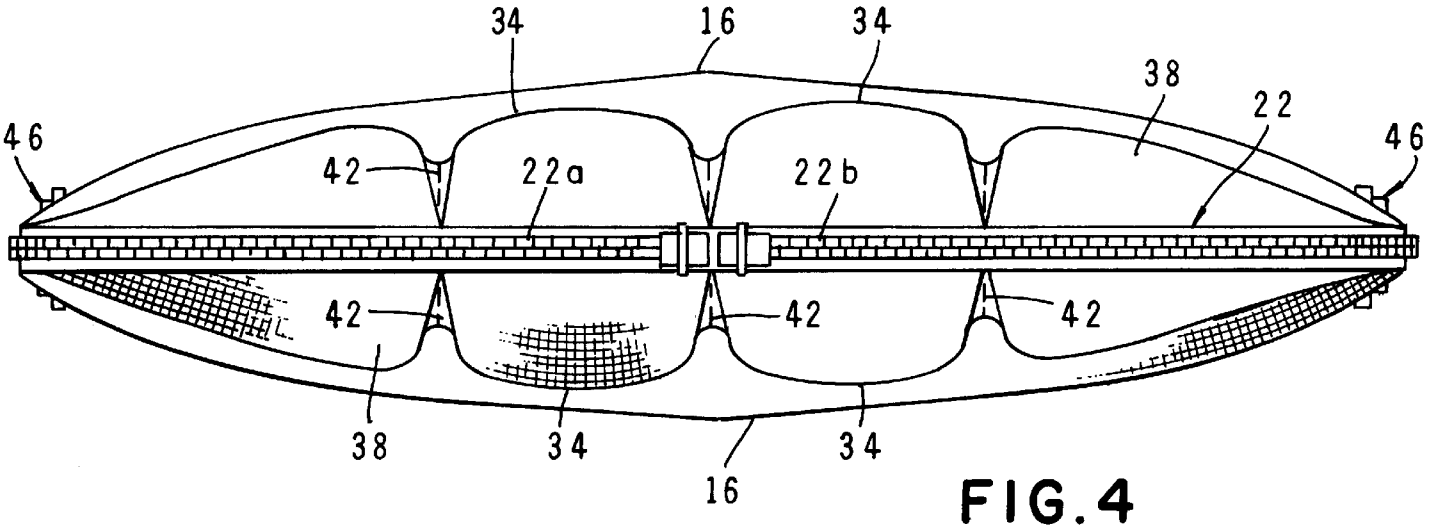
FIG. 4 is a view taken along lines 4—4 of FIG. 2.
Figure 5:
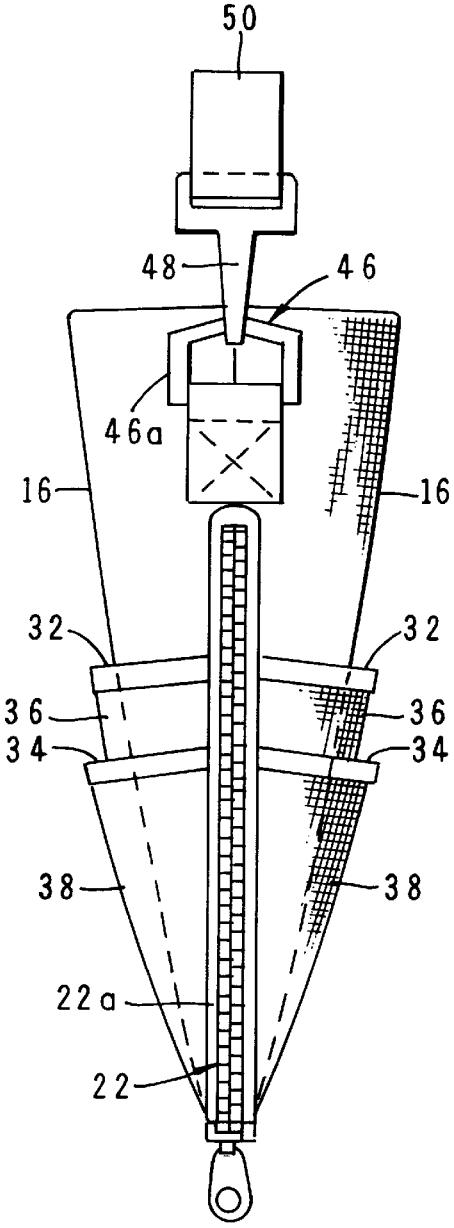
FIG. 5 is a view taken along lines 5—5 of FIG. 2.

In order to convert the apparatus from the bucket organizer configuration shown in FIGS. 8 and 9, into the tote bag configuration shown in FIGS. 1 through 6, closure means are provided. These closure means here function to securely close the generally circular shaped opening 18 formed in exterior walls 16 so as to define a top open, article-receiving chamber 20 of the character best seen in FIGS. 6 and 7. While the closure means can take several forms well known to those skilled in the art, the closure means is here shown as a conventional heavy-duty zipper mechanism 22 which is provided in two parts 22*a* and 22*b* (FIG. 3). With the construction thus described, when it is desired to convert the apparatus from the bucket organizer shown in FIGS. 8 and 9 into the tote bag configuration shown in FIGS. 1 through 6, the apparatus is removed from the empty container "C", is flattened in the manner shown in FIG. 7, and the zipper mechanism 22 is operated to close the bottom, generally circular-shaped opening 16 defined by the downwardly depending exterior walls of the apparatus. When the closure means or zipper 22 is closed, the apparatus takes on the configuration shown in FIGS. 1 through 6 and includes the top open article receiving chamber 20 which is of the configuration best seen in FIGS. 6 and 7.

Turning to FIG. 8, it is to be noted that the interior, downwardly depending wall 14 is provided with a plurality of article-receiving pockets 24. Pockets 24 are formed by an internal panel 26 which is interconnected at its lower margin 26*a* with lower margin 14*b* of downwardly depending wall 14 (FIG. 9). Wall 26 is initially spaced apart from wall 14 so that when panel 26 is interconnected with wall 14 by a plurality of vertically extending seam lines 30 (FIG. 8), pockets 24 are formed. Seam lines 30 can be formed in a conventional manner as, for example, by machine sewing techniques well understood by those skilled in the art.

Figure 7:
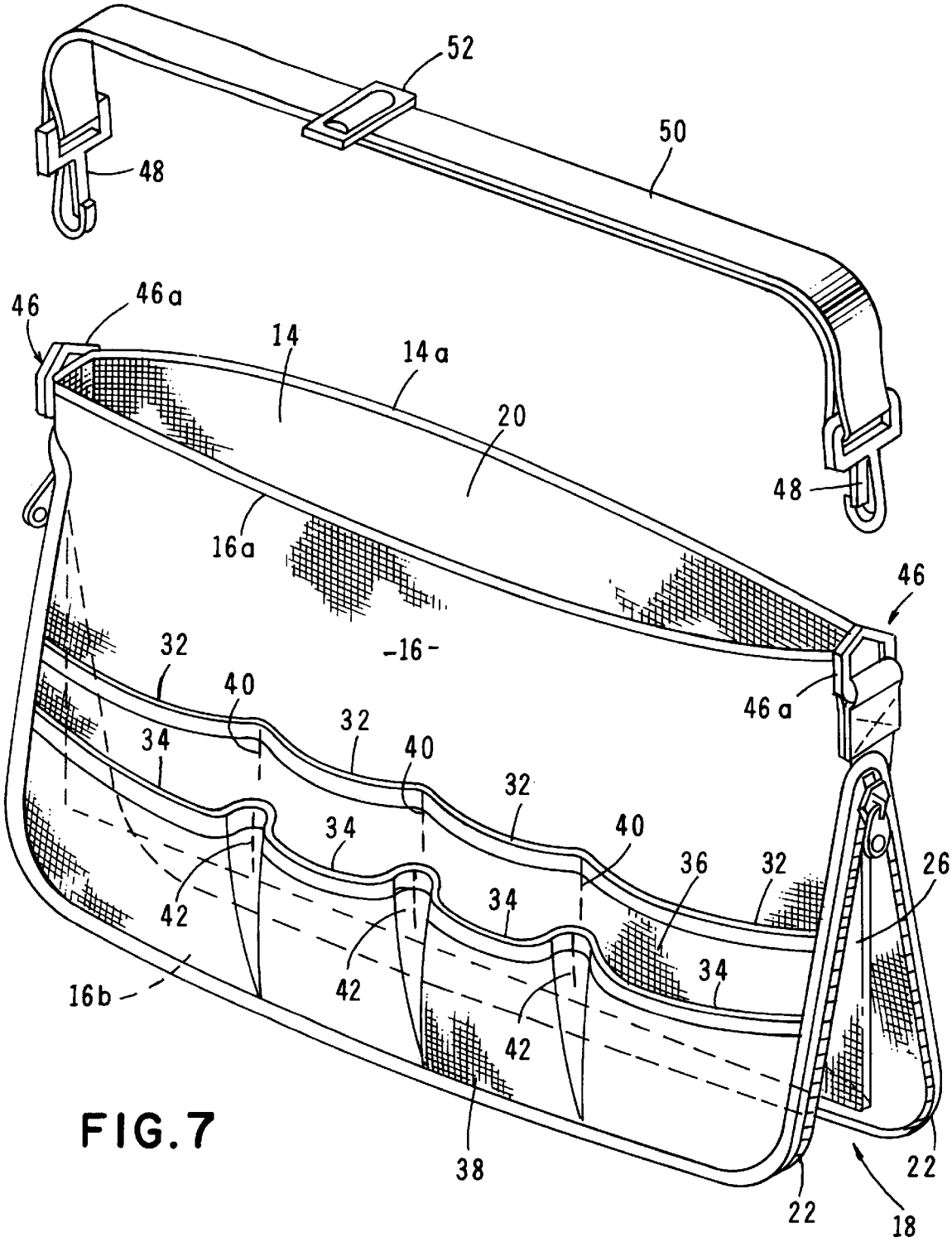
FIG. 7 is a generally perspective, exploded view of the apparatus shown in FIG. 1 illustrating the appearance of the apparatus shown in FIG. 1 illustrating the appearance of the apparatus when the shoulder strap is removed and when the closure means for closing the lower margin of the device in a open position.

In similar fashion, second exterior wall 16 is also provided with a plurality of article receiving pockets 32 and 34 (FIGS. 7 and 8). Pockets 32 are formed within a first panel 36 which is interconnected proximate its lower margin with wall 16 in a manner best seen in FIG. 9. Pockets 34, on the other hand, are formed in a second panel 38 which is connected as by machine sewing to panel 36 in an overlaying position as shown in FIG. 9. Once again pockets 32 are formed by a plurality of circumferentially spaced seam lines 40 which interconnect panel 36 with downwardly depending wall 16 at a plurality of circumferentially spaced locations. In a similar manner pockets 34 are defined by a plurality of seam lines 42 which function to interconnect panel 38 with panel 36 at spaced-apart locations. Seam lines 40 and 42 are once again made preferably by machine sewing using techniques well known to those skilled in the art.

Interconnected with walls 16 at spaced-apart locations, are first and second connector elements 46 (FIG. 7). Connector elements 46 include a loop-like element 46*a* which is adapted to receive a generally hooked shaped, clip-like connector 48 provided at either end of an elongated adjustable carrier strap 50. Carrying strap 50 is of a conventional construction and includes buckle means 52 of conventional construction which can be operated to increase or decrease the overall length of the carrier strap 50 so that the strap may be used as either a shoulder strap or alternately as a hand engaging strap for use in transporting the apparatus when it is in its tote bag configuration. Strap assembly 50 can be removed from the connector elements 46 in the manner illustrated in FIG. 7 by unhooking spring biased connectors 48 from connectors 46*a*.

Figure 1:
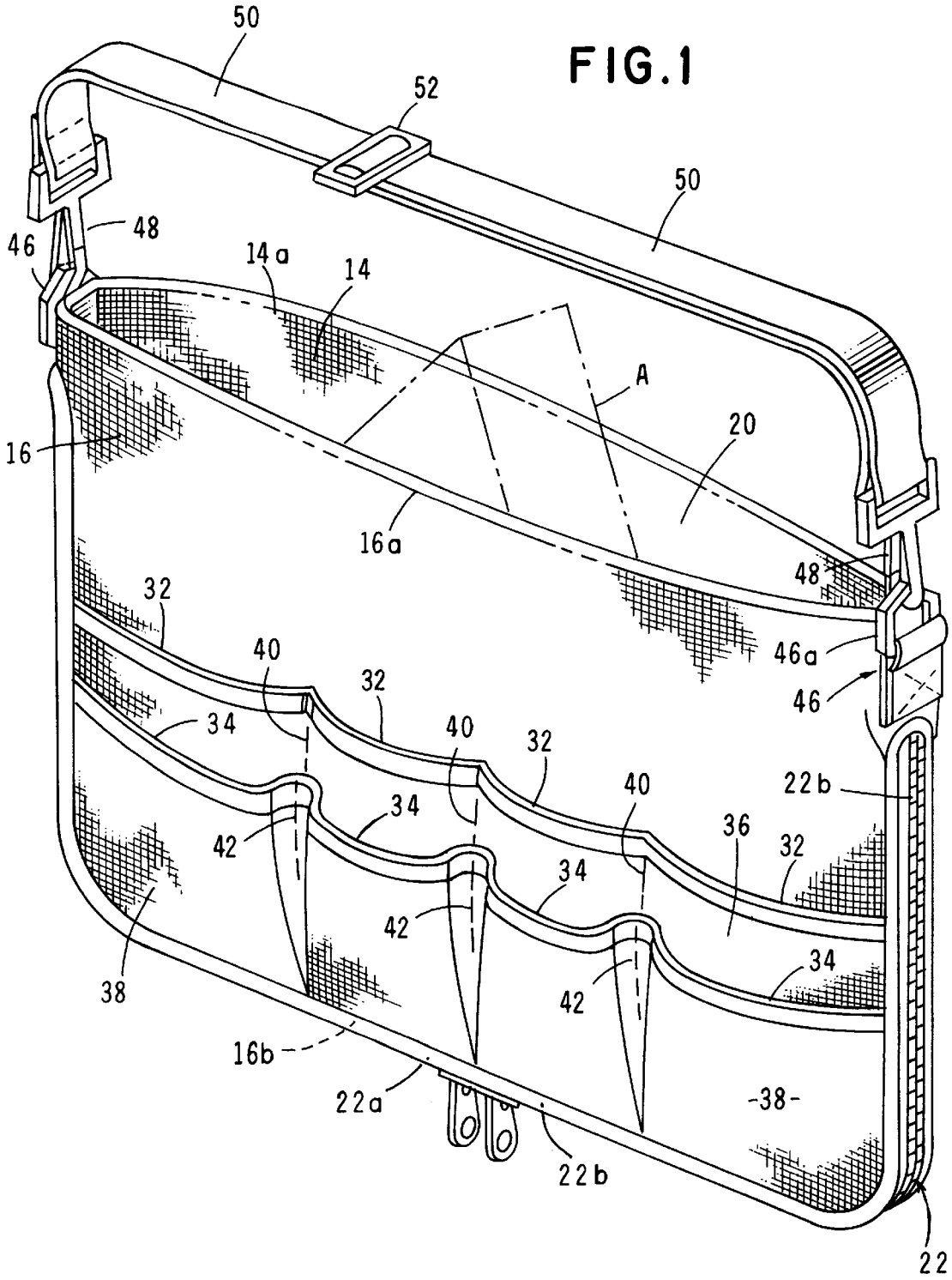
FIG. 1 is a generally perspective view of one form of the article transport and organizer of the present invention shown as a tote bag.
Figure 2:
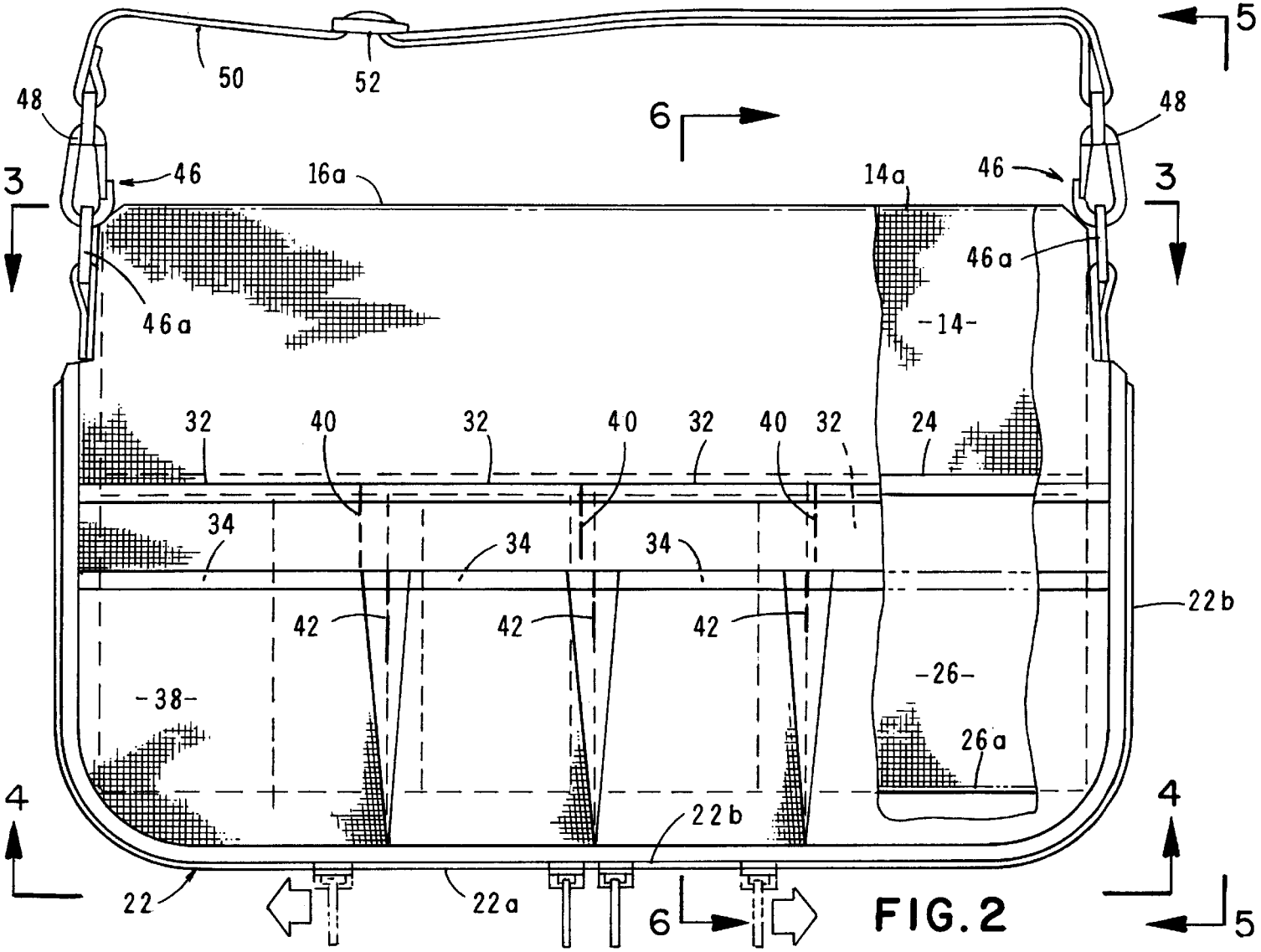
FIG. 2 is a side elevational view of the apparatus shown in FIG. 1.

When the apparatus of the invention is in its tote bag configuration shown in FIG. 1, various articles "A" can be emplaced in chamber 20 and within interior and exterior pockets 24, 32, and 34. When used as a tote bag, strap 50 is preferably interconnected with the body portion of the tote bag shown in FIG. 1. When so connected, the tote bag can be used to conveniently transport and store a number of different types of small articles "A" and a number of different types of small tools "T" in a manner illustrated by the phantom lines in the drawings.

When it is desired to convert the apparatus from the tote bag to the configuration shown in FIGS. 8 and 9, strap 50 is first removed from the tote bag body illustrated in FIG. 67. This done, zipper mechanism 22 is operated so as to disconnect the terminal portions 16*b* of external wall 16 to form the bottom open configuration shown in FIGS. 8 and 9. With the zipper mechanism open, the apparatus can be expanded so as to conveniently fit over the empty bucket "B" in a manner shown in FIGS. 8 and 9. When so interconnected with container "C", wall 14 depends downwardly into the interior of the container with wall 14 in close proximity with the inner wall of the container. Similarly, wall 16 is draped over container rim "R" and extends downwardly proximate the outer surface of the bucket wall in the manner best seen in FIG. 9. When the apparatus is in the bucket organizer configuration shown in FIGS. 8 and 9, interior pockets 24 can conveniently be used to organize small tools and various other articles which would otherwise become intermingled in the bottom of the container. Similarly, small articles and tools can be emplaced within pockets 32 and 34 which are now on the exterior wall of the container "C". It is to be understood with the pocket organizer in place within the container as shown in FIGS. 8 and 9, the internal chamber of the container is open in the manner shown in FIG. 9 to receive a number of other types of articles and supplies that are to be transported from work station to work station.

Having now described the invention in detail in accordance with the requirements of the patent statutes, those skilled in this art will have no difficulty in making changes and modifications in the individual parts or their relative assembly in order to meet specific requirements or conditions. Such changes and modification may be made without departing from the scope and spirit of the invention as set forth in the claims.

I claim:

1. An article storage device receivable over a container having an exterior wall and an interior wall which is generally circular in cross section at any point, the walls terminating in an upper rim portion, said device comprising:

(a) a first downwardly depending flexible wall, said wall having an upper margin and a lower margin and having an interior surface and an exterior surface, said first wall being receivable interiorly of the container with said upper margin thereof disposed proximate said upper rim portion of the container;

(b) a second flexible wall having an upper margin and a lower margin, said upper margin of said second wall being connected to said upper margin of said first wall, said second wall having an interior surface and an exterior surface, said second wall cooperating with said first wall to define a top opening, said lower margin of said second wall defining a bottom opening said second wall being receivable over the upper rim portion of the container so as to circumscribe the exterior surface of the container; and (c) closure means for closing said bottom opening to form a top open article receiving chamber.

2. An article storage device as defined in claim 1 in which said first downwardly depending wall is provided with a plurality of article receiving pockets.

3. An article storage device as defined in claim 1 in which said second wall is provided with a plurality of article receiving pockets.

4. An article storage device as defined in claim 1 in which said device further includes a carrying strap interconnected with one of the said first and second walls.

5. An article storage device as defined in claim 1 in which said closure means comprises a zipper.

6. An article storage device receivable over a container having an exterior wall and an interior wall which is generally circular in cross section at any point, the walls terminating in an upper rim portion, said device comprising:

(a) a first downwardly depending of a first length, said wall having an upper margin and a lower margin and having an interior surface and an exterior surface, said first wall being receivable interiorly of the container with said upper margin thereof in engagement with the upper rim portion of the container;

(b) a second wall having an upper margin and a lower margin, said upper margin of said second wall being connected to said upper margin of said first wall, said lower margin of said second wall defining an opening, said second wall being of a second length greater than said first length and having an interior surface and an exterior surface, said second wall being receivable over the upper rim portion of the container so as to circumscribe the exterior surface of the container; and (c) closure means for closing said opening.

7. An article storage device as defined in claim 6 further including a first panel interconnected with said exterior surface of said second wall and a second panel interconnected with said first panel in an overlaying position.

8. An article storage device as defined in claim 7 in which said first and second panels cooperate with said second wall to define a plurality of article storage compartments.

9. An article storage device receivable over a container having an exterior wall and an interior wall which is generally circular in cross section at any point, the walls terminating in an upper rim portion, said device comprising:

(a) a first downwardly depending, flexible wall of a first length, said wall having an upper margin and a lower margin and having an interior surface and an exterior surface, said first wall being receivable interiorly of the container with said upper margin thereof in engagement with the upper rim portion of the container; said first downwardly depending wall being provided with a plurality of article receiving pockets;

(b) a second wall having an upper margin and a lower margin, said upper margin of said second wall being connected to said upper margin of said first wall, said second wall being of a second length greater than said first length and having an interior surface and an exterior surface, said lower margin of said second wall defining an opening, said second wall being receivable over the upper rim portion of the container so as to circumscribe the exterior surface of the container, said second wall being provided with a plurality of article receiving pockets;

(c) closure means for closing said opening to define a top open article receiving chamber bounded by said interior surface of said second wall, said closure means comprising a zipper;

(d) first and second spaced-apart connector elements connected to said second wall; and (e) an elongated carrying strap releasably interconnected with said connector elements.

* * * * *